US005931746A

United States Patent [19]

Soong

[11] Patent Number: 5,931,746

[45] Date of Patent: Aug. 3, 1999

[54] GOLF CLUB HEAD HAVING A TENSILE PRE-STRESSED FACE PLATE

[76] Inventor: Tsai C. Soong, 1839 Jackson Rd., Penfield, N.Y. 14526

[21] Appl. No.: 09/062,689

[22] Filed: Apr. 20, 1998

Related U.S. Application Data

[63] Continuation-in-part of application No. 08/861,202, May 21, 1997, abandoned.

[51] Int. Cl.[6] ..... A63B 53/04

[52] U.S. Cl. ..... 473/329; 473/342

[58] Field of Search ..... 473/324, 325, 473/326, 327, 328, 329, 330, 331, 332, 333, 334, 335, 336, 337, 338, 339–350, 223, 287, 291

[56] References Cited

U.S. PATENT DOCUMENTS

| | | | |
|---|---|---|---|
| 1,359,220 | 11/1920 | Beamer . | |
| 4,792,140 | 12/1988 | Yamaguchi | 473/342 |
| 5,024,437 | 6/1991 | Anderson | 473/342 |
| 5,176,384 | 1/1993 | Sata | 473/329 |
| 5,282,624 | 2/1994 | Viste | 473/342 |
| 5,310,185 | 5/1994 | Viollaz | 473/342 |
| 5,316,304 | 5/1994 | Yost . | |
| 5,346,216 | 9/1994 | Aizawa | 473/329 |
| 5,464,211 | 11/1995 | Atkins | 473/346 |
| 5,464,212 | 11/1995 | Cook | 473/340 |
| 5,643,109 | 7/1997 | Rose | 473/329 |

FOREIGN PATENT DOCUMENTS

| | | | |
|---|---|---|---|
| 646942 | 8/1962 | Canada | 273/80.7 |

*Primary Examiner*—Sebastiano Passaniti

[57] ABSTRACT

A golf club head comprising a body and a face plate coupled with the body wherein the face plate has a permanent tensile pre-stress, created in the manufacturing process, which is generally radial outward from the central area of the face plate towards the boundary which stiffens the face plate and reduces indentation of the plate when it impacts with the golf ball during play.

19 Claims, 2 Drawing Sheets

GOLF CLUB HEAD HAVING A TENSILE PRE-STRESSED FACE PLATE

This is a Continuation-in-Part of patent application Ser. No. 08/861,202, filed May 21, 1997 now abandoned.

BACKGROUND OF THE INVENTION

A conventional golf club head has a thick metal face plate to sustain the impact of the golf ball during play. The rest of the head is hollow, having thin walls supported by peripheral rims so that the head can have large moment of inertia about its center of gravity. The thickness of the face plate, for wood and iron drivers, have not been specified in literature. Measurements of conventional face plates yield about 2.0 to 4.0 mm in the central impact areas of these face plates.

Since a golf ball and the face plate of the head are made of hard materials, the contact area of both bodies during impact is very small, and the peak force at impact is large. The time of contact is extremely short, about a few thousandth of a second. As a result, dynamic energy of the head transmitted to the ball suffers considerable loss. In addition, surface irregularity affects accuracy, and the orientation of the resultant force which drives the ball towards the intended direction is difficult to control.

SUMMARY OF THE INVENTION

An object of the present invention is to reduce the thickness of the convention face plate so that material saved from the face plate can be used to increase the moment of inertia of the head. A second objective is to control the direction of the resultant force on the ball so that accuracy of the movement of the ball can be improved. Both objectives can be accomplished by having the face plate substantially thinner than the conventional face plate so that material is saved, and when the thin face plate is indented, it conforms to the contour of the ball at the contact area, whereby the direction of the impact force and how the club should be swung can be anticipated by the golfer.

The above noted objectives are provided by a golf club head having a face plate, comprising at least one plate-like element, engaged to a club head body having a front end formed with peripheral rims around for connecting the edge flanges of the face plate to the body, and in a manner wherein the face plate is substantially pre-stressed with tension, or called pre-tension, at least in its central area. Central area is defined as the area bounded by but extending away from the peripheral edges of the face plate.

The face plate may be multi-layered, including composites, may have nonstructural inserts or attachments. However, it is the face plate which carries the majority of the pre-tensioned loads. Also, even though the improvement will not be significant if the pre-tension is not substantial, incremental adaptation of the invention can have incremental benefit. The pre-tension stretches the central area of the face plate towards the rim, and is adapted to stiffen the face plate against the impact and to reduce the indentation of the face plate during ball play. It is to be noted again that it is of crucial importance that the pre-stress be of a tensile nature. The purpose is not to reduce damage of the head due to impact, nor to provide cushion, but rather to sustain impact in a different but superior way than simply putting more metal on the face plate.

The face plate may include edge flanges in its circumference which pulls the face plate radially outward, and is anchored to the peripheral rims in a permanent manner.

It is to be noted that the introduction of the tensile pre-stress to the face plate does not turn the device into a spring. Impact of two elastic bodies such as a plastic golf club ball to a metallic surface always involve surface movement of impacting bodies. In the prior art, the thickness of the face plate of a golf club head is generally arbitrary. There was no lower limit of face plate thickness indicated in prior art.

BRIEF DESCRIPTION OF THE DRAWINGS

Figures only depict some of the preferred embodiments of the invention among all practically feasible and desirable arrangements.

DESCRIPTION OF THE PREFERRED EMBODIMENTS

Figure 1:
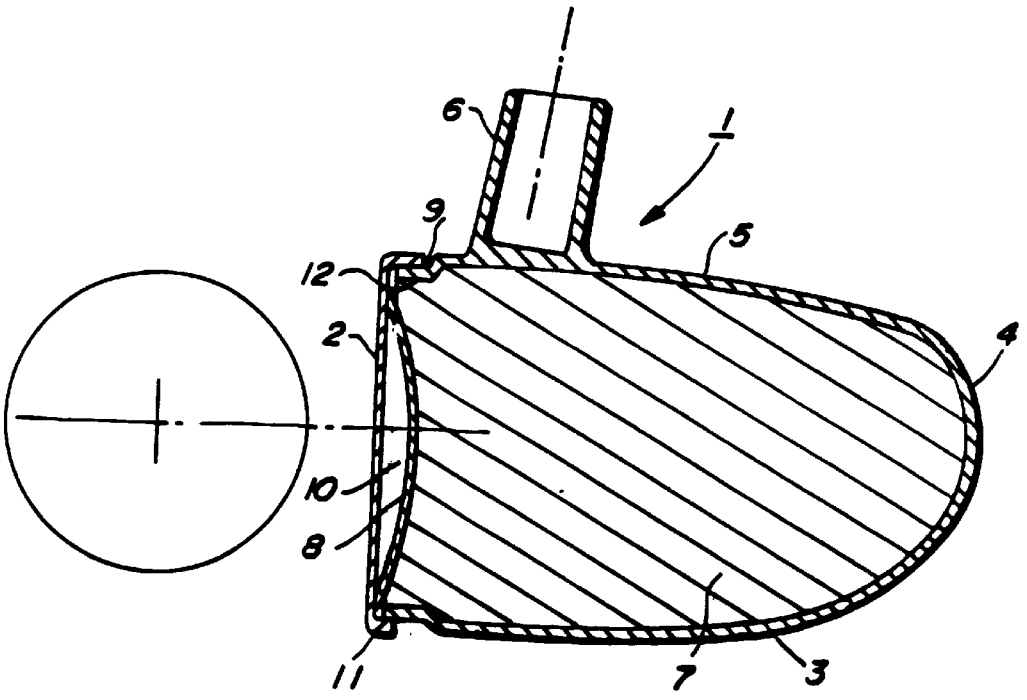
FIG. 1 shows a preferred embodiment of the invention applied to a golf club.

The shape of the face plate of the head of the invention looking along the direction of the ball is similar to a conventional head. FIG. 1 shows a preferred embodiment of the invention, shown in a typical cross section along its width, wherein the head 1 including a face plate 2 facing the ball, having at least one plate-like structural element, and a hollow body 3 formed with a rear end 4, a middle section 5 which may include optional filler material 7, and a front end 9 connecting the hollow body to the face plate. The front end 9, having at least the peripheral rims 12 circumscribing the boundary of the face plate, may be an annular ring type bracket, anchoring the face plate to the body. The front end may include a wall 8 which may be solid or formed with stiffening panels. There may be a clearance space 10 behind the face plate, with cushion or without cushion. The usual shaft holder 6 may be located in the middle section 5.

A preferred material of the face plate is high carbon steel, titanium or their alloys. Other hard resilient materials or fiber-reinforced composites may also be used. It may be multi-layered, including layers composed of different materials. The central area of the face plate is generally flat or slightly curved. The surface facing the ball may have grooves, dimples, or roughened as the conventional golf club head. Substrates of different material, which is not shown may be attached to the face plate, for the purpose of cushion, friction, damping or other non-structural purpose. The face plate 2 is the major load-carrying structural element arranged to engage the rim 12 through edge flanges 11 which should be permanently fixed over and around at least a part of the rim 12 of the front end. Because of the elongated shape of the face plate, the upper and lower rims are generally long and approximately parallel. The edge flanges may be mechanically fixed to the rims 12 such as by weld or rivet, or folded over the rims as shown, or under it, or may be inserted at an angle into receiving slots or openings made in the rims adapted to engage the edge flanges. The slots or openings will be pressed tight upon the edge flange so that it can not slip back out after they are in place. Predetermined tensile stress should be permanently instituted at least in the central area of the face plate after assembling is complete.

It is imperative that there is no media material or substrate on the surface of the face plate facing the ball. However if there is a media substrate, for frictional or damping purpose, it must be very thin and non-structural, so that when the face plate impacts with the ball and bends, the tensile stress around the circumference of the indented contact circle of the plate would form a clearly defined resultant force, in direction and in magnitude, along the incoming direction of the ball and resists its advance. A thick substrate will blur and distort the boundary of the contact circle which would be detrimental to the purpose of having the pre-tension.

To produce the pre-tension in the central area of the face plate, one way is by shrink-fit, described as follows. The dimension of the face plate is designed smaller than the corresponding dimension of the front end by an amount called interference. The front end has to shrink in order for the face plate to be able to stretched over or into it. That is why it is called shrink-fit. But to raise the temperature of the face plate may be simpler in practice. To begin assembling, the face plate is heated to a higher temperature while the body, including the front end, is held at the ambient temperature. When the temperature is high enough, the expanded edge flanges of the face plate should be easily slipped over the rims, or be inserted into the slots made in the peripheral rims without difficulty. After the adaptation of the face plate onto the rims of the front end is completed, the joining is made permanent by conventional means such as welding, riveting, or by compressive force along the rims to close the slots, etc. Afterwards, the assembly is left to be cooled to the ambient temperature thereby the desired tensile pre-stress in the face plate is permanently instituted. The interference determines the amount of the resulting tensile pre-stress in the face plate.

Other methods to produce tensile pre-stress include, but is not limited to, metallurgically altering face plate molecules so that a predetermined tensile pre-stress may be produced by some means after it is installed on the rim, or mechanically stretching the plate, pulling it and fixing it over the rim by mechanical means, such as riveting, welding, etc.

Figure 2:
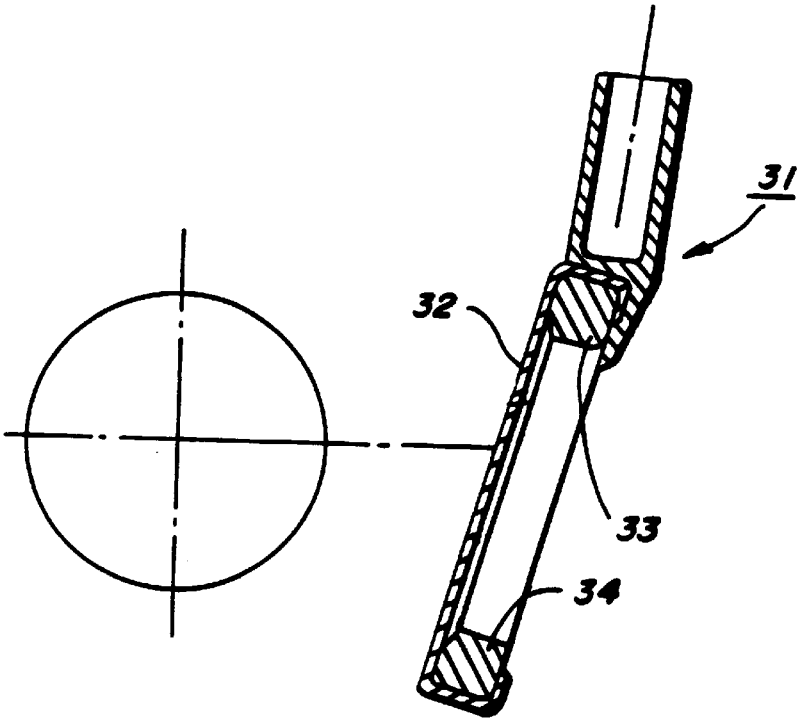
FIG. 2 shows another preferred embodiment in which the body is an annular ring type.

FIG. 2 shows the invention is applied to an iron club head 31, wherein the body is an annular ring type hollow structure. In the example, the face plate 32 joins the front end by overlapping at the rims. The cross section shows the upper rim 33 and the lower rim 34. Side rims are not shown. Instead of overlapping, slots may be cut in the rims for receiving and anchoring the edge flanges as described before. There may be a wall or panels approximately parallel to and behind the face plate for supporting purpose. Spacing, with or without cushion, may be provided behind the face plate.

Adjustment of the magnitude of the pre-tension may be provided, for example, by conventional mechanical means, not described here, such as screw and thread devices, to increase or decrease the distance between the two parallel rims 33 and 34, so that the pre-set tensile stress in the central areas of the face plate can be increased or decreased accordingly. The adjustment can be done before the golf club is used in a play. Since the structure is relatively rigid, this arrangement is more practical in putters than drivers.

Figure 3:
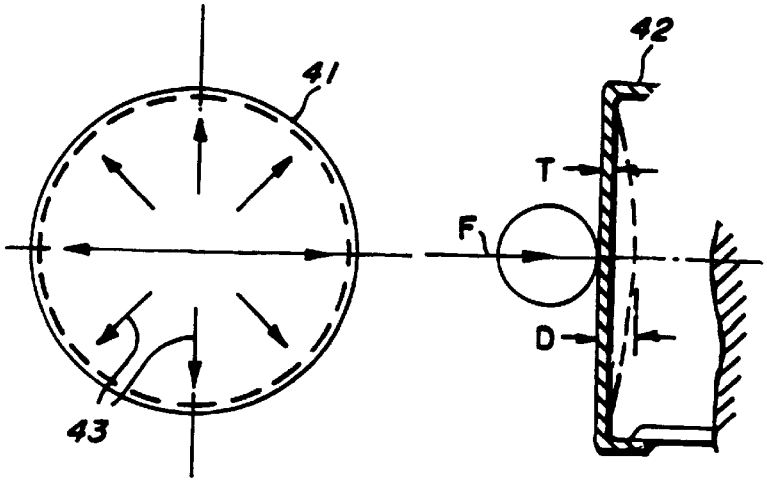
FIG. 3 shows a sample of a circular face element indented by impact as affected by different face element thickness and temperature difference.
Figure 4:
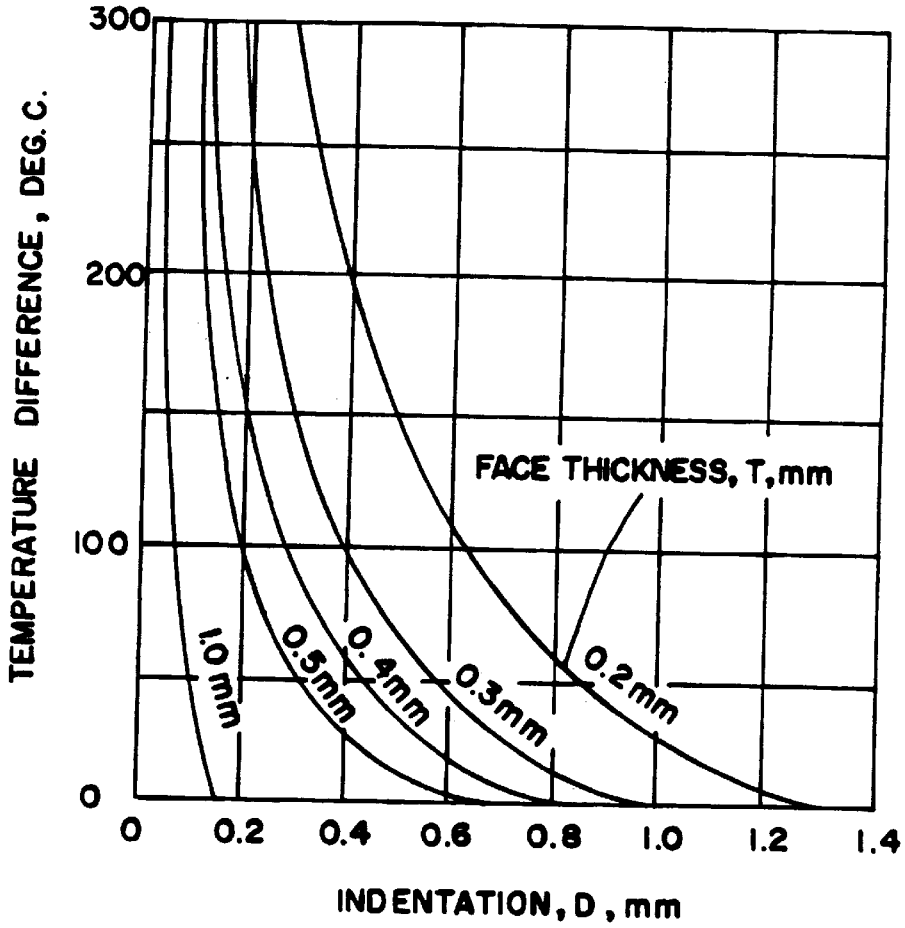
FIG. 4 shows the computed result of the FIG. 3 geometry.

In FIGS. 3 and 4, the indentation at the center of a face plate caused by the impact of a ball is calculated as a function of the thickness of the plate and the shrink-fit temperature effect which produced the tensile pre-stress in accordance with the calculations. The calculation is made by the nonlinear finite element method (FEM), the ABACUS computer program.

FIG. 3 shows a steel circular face plate, 80 mm in diameter, held rigid at the rim by the body 44 wherein 41 is the plane view, 42 is in the side view, of the face plate. The size and geometry of the model resembles the central area of a face plate of a club head. Thermal stress 43 due to shrink-fit is shown as a rotational axisymmetric, tensile stress, pulling radially outward towards the rim. It resembles the central area of a face plate under a prescribed tensile pre-stress due to shrink-fit when the temperature difference between the plate and the rigid rim is given. The impact force F hitting the face element is taken as 9.00 kg. which is about average. The thickness of the face element, T, varies from 0.2 mm to 1.0 mm. In the prior art, face plates are relatively thick, their use of thin face plates has not been disclosed since thin face plates would not be feasible for the prior art form of club heads. It is possible only because of the proposed pretension stiffening effect, in accordance with the present invention. Technique of pretension had two famous applications before: In the early years of the $20^{th}$ century, Germans strengthened the gun barrel against burst by spirally winding tensioned steel wires in the core of the gun barrel; and in 70s, construction industry used pre-tensioned steel rods in cement beams to pre-condition the reinforced beams for higher bending strength.

The dotted line in FIG. 3 shows the displaced face plate. The resultant force, formed by the tensile pre-stress in the indented face plate, resists the advance of the ball. The thin plate is expected to conform to the contour of the ball at the contact area because it is thin relative to the prior art disclosed thick plates.

FIG. 4 shows the analytic results. At plate thickness of 1.0 mm, the effect of tensile pre-stress to reduce indentation begins to be noticeable. It is suggested to take 1.0 mm as the upper threshold of face plate thickness. This assertion should be allowed to stand if only because were the tensile pre-stress have not stiffened the face plate, no person having ordinary skill in the art to which said subject matter pertains would ever give this assertion a second thought.

FIG. 4 supplies some analytical details. For example, with face plate at 0.5 mm thick, the impact produces an indentation of 0.63 mm. If a thinner face plate of 0.2 mm is used, the same impact force would produce a greater indentation of 1.3 mm. However, if a thinner plate 0.2 mm is used in conjunction with a shrink-fit temperature of 100 deg. C, the indentation is reduced to 0.63 mm, due to the pre-tension. The weight saved by using the 0.2 mm plate instead of the 0.5 mm plate is 60%. In FIG. 4, a plate thickness of 0.5 mm shows the largest indentation reduction per unit degree temperature difference among the curves shown. The 0.5 mm value is here taken as a more preferred face plate thickness.

A working stress of 3,500 kg/cm$^2$ has been taken in industry as a reliable working stress having adequate factor of safety, for steel or titanium plate in general applications. Steel has a Young's modulus of 2,114,000 kg/cm$^2$ and a thermal expansion coefficient of $11.65\times10^{-6}$/deg. C. Based on these numbers, it follows that the tensile strain created to reach the tensile stress of 3,500 kg/cm$^2$ is about 0.0017 mm/mm. This is a manageable strain to be used in machine shop fabrications. This tensile pre-stress may be created in the face plate by conventional means including using a shrink-fit temperature of about 150 deg. C. The above general discussion shows for steel, titanium, and alloys, a couple of hundreds degrees in C used in shrink-fit, which creates a strain of about 0.002 mm/mm, is well in the scope of the range of applications suggested, in accordance with the present invention.

In above discussions, stress and strain are average values measured in the central areas of the face plate, at the mid-plane bisecting the thickness of the face plate, along the principal axis of the face plate which is perpendicular to the ground level when the head is positioned relative thereto during play.

The following relates to technology applied to putter design. Present day emphasis is to have inserts of different materials engaged at the impact face of the head of the putter to "contain" the ball or cushion the impact force. The invention applied to putter is to have a thin face plate of such thickness that the dented plate clearly wraps around the ball and the inclined tensile pre-stress tangent to the contact contour forms a force resultant which is clearly perpendicular to the plane of the undeformed face plate. The high pre-tension enlarges the sweet spot area. A golfer needs only to impact the ball squarely by the head with suitable force. The pre-tensioned face plate will guide the ball along the direction that the head is aimed regardless of the local contact and surface irregularities that often distorts the movement of a ball in the use of a putter.

Theoretical analysis shows the upper threshold of the face plate thickness with respect to putters for good conformity in contact is not more than about 0.50 mm. for a steel face plate. A more preferred number is not more than about 0.25 mm. Again, the criteria is not established due to considerations of critical stress and strain in the material the impact ensues. It would be impractical in the present case where the impact force on a putter is so small and the environment in putting is so complicated. Rather, the suggested criteria 0.25 mm is an analytical judgement which is so drastically different from the prior art, that if not because of the pre-tension involved in the claim, no one skilled in the art would ever give the idea a serious thought.

In considering the prior art, there is no reference whatsoever on golf club head comprising a face plate having predetermined tensile pre-stress. In U.S. Pat. No. 5,346,216, the patentee suggested to have a cushion element squeezed into an empty front space provided by a bracket which corresponds to a front end of the head to reduce impact of the ball. It is deemed that squeezing the cushion into the bracket produced a pre-stress. A crucial difference is that the patentee's pre-stress, if any, is a compressive stress; the insertion of the cushion, according to the patentee, is to enhance feeling. A tensile pre-stress will not serve the patentee's purpose; his teaching would not teach one skilled in the art how to take advantage of applying pre-tension to the face plate to make up for the reduction of structural stiffness after the plate is made substantially thinner. Finally, the presence of a media substance in the patentee's design between the surfaces of the ball and the face plate when they impact would have reduced the effectiveness of the present invention.

What is claimed is:

1. A golf club head for use with a golf club comprising a body, a planar face element engaged to said body and spaced therefrom, and a rim formed about an exterior surface of said body adjacent a portion thereof, and adapted to engage said face element, wherein said face element, at least in its central area, is in a substantially, tensile, pre-stressed condition engaging said body, adapted to stiffen said face element and reduce the indentation of the same during its impact with a ball during play.

2. The golf club as defined in claim 1 wherein said tensile, pre-stressed condition extends radially outward towards said rim of said face element from central areas of said face element, its presence reducing the magnitude of the compressive stress inflicted on said face element during impact with the golf ball, thereby stiffening said face element against impact during play.

3. The golf club head as defined in claim 2 wherein at least a portion of said body is made of reinforced fiber/resin composite.

4. The golf club head as defined in claim 1 wherein the golf club head has a hollow interior, and wherein said body portion includes a front end arrayed for engaging said face element, a rear end and a middle section connecting said rear end to said front end.

5. The golf club head as defined in claim 4 wherein said front end includes a solid wall approximately parallel to said face element.

6. The golf club as defined in claim 1 wherein the golf club head has a hollow interior, and wherein said face element is permanently joined to said body portion, the latter being essentially a rigid, annular structure with a hollow interior.

7. The golf club head as defined in claim 1 wherein the thickness of said face element is approximately 1.0 mm.

8. The golf club head as defined in claim 1 wherein the thickness of said face element is approximately 0.5 mm.

9. The golf club head as defined in claim 1 wherein the thickness of said face element is approximately 0.25 mm.

10. A golf club head for use with a golf club comprising a body, a planar face element engaged to said body and spaced therefrom, and a rim formed about an exterior surface of said element adjacent a portion of said body and adapted to engage said face element, and wherein said face element, at least in its central area, is in a substantially, shrink-fit induced, pre-stressed condition engaging said body, adapted to stifffen said face element and reduce the indentation of the same during impact with a golf ball during play, said face element including an edge flange, and being arranged for overlapping said rim of said body along where said face element and said body are joined, whereby said body can support said face element after said shrink-fitting.

11. A golf club head for use with a golf club comprising a planar face element engaged to said body and spaced therefrom, and a rim formed about an exterior surface of said body adjacent a portion of said body and adapted to engage said face element, and wherein said face element is in a substantially, tensile, pre-stressed condition engaging said body, adapted to stiffen said face element and reduce the indentation of the same during its impact with a golf ball during play, said face element being formed with an edge flange wherein said edge flange is fixed to said rim of said body along the section where said face element and said body are joined, whereby said body can support said face element with a tensile pre-stress.

12. A golf club for use with a golf club comprising a body having peripheral rims and a planar face plate facing the direction a ball travels after impact thereof, said peripheral rims being arranged to join said face plate rigidly to and spaced from said body, said face plate being substantially pre-stressed engaging said body extending approximately outwardly towards said peripheral rims from a central area of said face plate, said face plate being adapted to contact and partially envelop the impacting ball directly surface to surface, offering a large contact surface, forming a greater force resultant to resist the advance of the ball due to the presence of the pre-stress, thereby effectively reducing the indentation of the ball during play.

13. The golf club head as defined in claim 12 wherein the average thickness in said central area of said face plate is not more than about 0.50 mm.

14. The golf club head as defined in claim 12 wherein the average thickness in said central area of said face plate is not more than about 0.25 mm.

15. The golf club head as defined in claim 12 wherein said body includes a front end adapted for engaging said face plate, a rear and a middle section connecting said rear end to said front end.

16. The golf club head as defined in claim 15 wherein said front end includes a wall approximately parallel to and adjacent said face plate.

17. The golf club head as defined in claim 12 wherein said pre-stressed plate is joined to said peripheral rims of said body, said peripheral rims being essentially a rigid, annular ring circumscribing said face plate.

18. The golf club head as defined in claim 12 wherein said face plate is formed with edge flanges stretching and pulling said face plate to said peripheral rims of said body thereby sustaining said tensile pre-stress of said face plate.

19. The golf club head as defined in claim 12 wherein the average thickness in said central area of said face plate is not more than about 1.0 mm.

* * * * *